United States Patent [19]

Giordano

[11] Patent Number: 4,629,863

[45] Date of Patent: Dec. 16, 1986

[54] MOUTHPIECE FOR HAIRDRYER

[76] Inventor: Jose Giordano, 4, Av. Mousquines, Lausanne, Switzerland, 1005

[21] Appl. No.: 309,894

[22] PCT Filed: Jan. 19, 1981

[86] PCT No.: PCT/CH81/00005

§ 371 Date: Oct. 6, 1981

§ 102(e) Date: Oct. 6, 1981

[87] PCT Pub. No.: WO81/02246

PCT Pub. Date: Aug. 20, 1981

[30] Foreign Application Priority Data

Feb. 13, 1980 [CH] Switzerland ..... 1157/80

[51] Int. Cl.[4] ..... A45D 20/12; F24H 3/00; B05B 1/28

[52] U.S. Cl. ..... 219/373; 34/97; 132/9; 219/369; 239/523

[58] Field of Search ..... 219/373, 369, 370, 371, 219/372; 34/96, 97, 98, 99, 100, 101; 132/118, 112-115, 9; 239/499, 521, 523, 524

[56] References Cited

U.S. PATENT DOCUMENTS

| | | | |
|---|---|---|---|
| 1,946,638 | 2/1934 | Rasmussen | 34/99 |
| 1,951,269 | 3/1934 | Boeckx | 132/9 |
| 2,186,551 | 1/1940 | Lyon | 239/523 |
| 2,245,553 | 6/1941 | Biedermann et al. | 239/523 |
| 3,237,871 | 3/1966 | Vicard et al. | 239/523 |
| 3,364,590 | 1/1968 | Collins | 34/100 |
| 3,491,774 | 1/1970 | Carbone | 219/373 |
| 3,637,982 | 1/1972 | Reaves | 219/373 |
| 3,730,190 | 1/1973 | Ford | 132/11 |
| 3,835,869 | 9/1974 | Newman et al. | 34/97 |
| 3,861,060 | 1/1975 | McNair | 34/97 |
| 3,926,200 | 12/1975 | Losenno | 132/9 |
| 3,946,498 | 3/1976 | Waters et al. | 219/372 |
| 3,970,093 | 7/1976 | Lardenois | 34/97 |
| 4,005,720 | 2/1977 | Machata | 132/9 |
| 4,014,471 | 3/1977 | McGrane | 239/521 |
| 4,210,162 | 7/1980 | Dreyer et al. | 132/9 |
| 4,287,673 | 9/1981 | Wolter | 219/373 |
| 4,391,047 | 7/1983 | Jannssens et al. | 34/97 |
| 4,538,362 | 9/1985 | Andis | 219/370 |
| 4,551,615 | 11/1985 | Wilson | 219/370 |

FOREIGN PATENT DOCUMENTS

| | | | |
|---|---|---|---|
| 862485 | 12/1977 | Belgium . | |
| 2556808 | 7/1976 | Fed. Rep. of Germany | 219/373 |
| 341133 | 1/1931 | United Kingdom | 219/368 |

OTHER PUBLICATIONS

Des. 260,189—Winkler.

*Primary Examiner*—A. D. Pellinen
*Assistant Examiner*—Geoffrey S. Evans
*Attorney, Agent, or Firm*—Kimmel, Crowell & Weaver

[57] ABSTRACT

A hair dryer outlet nozzle having a slit-like outlet opening includes a forwardly and upwardly extending arcuate deflector of approximate half-circle form which directs drying air away from the scalp and forms a vortex of drying air around a cylindrical brush upon which hair is being wound during the drying process.

3 Claims, 2 Drawing Figures

MOUTHPIECE FOR HAIRDRYER

BACKGROUND OF INVENTION

A mouthpiece to curl and dry hairs is the subject matter of the present invention and more particularly a mouthpiece intended to be employed by combining it with a round brush such as those used by professional hairdressers, said axis being the longitudinal axis of a curling hair brush 6 employed by a hairdresser in conjunction with the hair dryer.

Numerous shapes for hairdryer mouthpieces are on the market. All these mouthpieces, nevertheless, have, in common, the fact that the flow of hot air produced by the hairdryer is directed in a more or less concentrated flow towards the roots of the hair, i.e. the scalp. Now, this flow of hot, dry air on the scalp has the effect of stimulating the glands and thus causing heavy secretion. Furthermore, the air flows towards the hair in the opposite direction of the cortex which is prejudicial to the hair. Besides, when the hairdresser is working with a round brush before the hairdryer, around which brush he rolls a lock of hair, he must be careful to direct the hairdryer so that the flow of air does not snatch the hair from the brush and, in order to do so, he must often hold the hairdryer in a difficult position.

The purpose of the present invention is to overcome these inconveniences and, in a positive manner, make sure that the flow of air is directed in a favourable direction.

With this in mind, the mouthpiece to curl and dry hairs according to the invention is distinguished by the fact that the surface of the extention is comprised by a round deflector (4) extended in a continous manner from the exit of the nozzle (3) till the front extremity is relative to the direction of the air flow (F) around an axis represented by a brush (6), hold by the user's hand, which is located ahead of the nozzle, the opening angle of the round deflector is of approximately 180°, the circular cylindrical surface is directed to the air flow (F).

DETAILED DESCRIPTION OF PREFERRED EMBODIMENT

Figure 1:
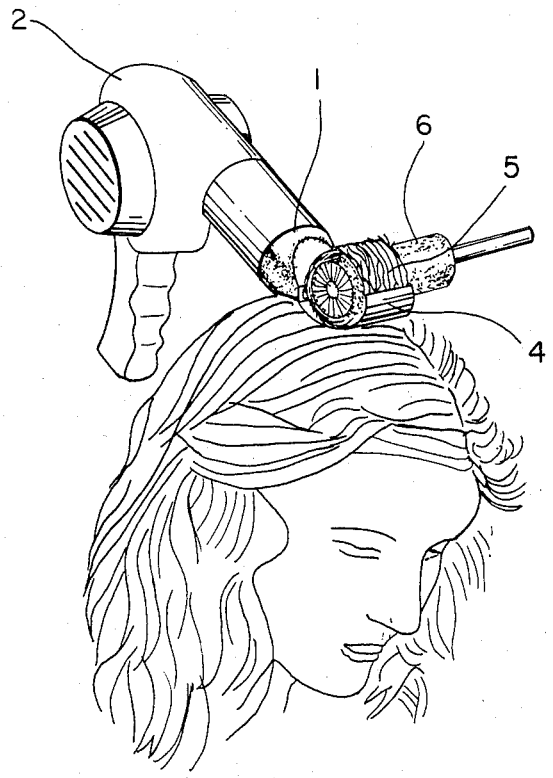
Figure 2:
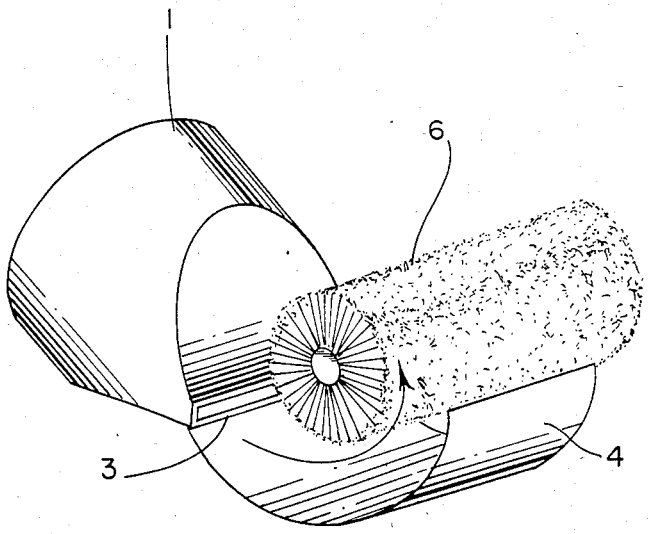

The deflector has several favourable effects, simultaneously: it protects the scalp from the hot-air flow; it directs the flow of hot air in such a way that it flows from the roots towards the tips of the hair; it generates a vortex effect enhancing the rolling up of hair about a round brush placed before the nozzle.

The attached drawing shows as an example the use of the invention.

BRIEF DESCRIPTION OF DRAWING FIGURES

FIG. (1) is a hairdryer supplied with a mouthpiece to curl and dry hairs according to the invention and shows its use with a round brush.

FIG. (2) is a detailed, perspective view of the mouthpiece.

The removable mouthpiece (1) is slipped into the end of a hairdryer (2), of any sort. The mouthpiece 1 is fitted with a nozzle (3) extended along the under side by a deflector (4) comprised of a cylindrical surface extending approximately 180° about an axis located 2 or 3 cms ahead of the nozzle (3). The mouthpiece may be made of injected synthetic material or of metal. In the example shown, the nozzle (3) has a relatively narrow rectangular opening concentrating the flow of hot air into the area limited by the deflector. The nozzle opening could nevertheless be of another shape, for instance, circular.

When the hairdryer is used with a round brush to shape the curls, the lock of hair (5) is rolled up in the usual way around the brush (6) and, simultaneously, the hairdryer (2) is positioned hear the head so that the extremity of the deflector (4) can go under the brush. The hairdryer (2) is held in the normal, convenient way, its axis being directed perceptibly perpendicularly to the head. You can see that in this position the scalp is protected from the flow of hot air (F) by the deflector (4). Moreover, this deflector gives the flow of air (F) a vortex effect round the brush, which enhances the rolling up and holds it in place. It is thus easy to obtain a perfect curl.

The invention is, naturally enough, not limited to shape of execution shown, but extends to any variant producing a cortex air effect.

I claim:

1. A nozzle attachment for a hand-held hair dryer comprising:

a body portion for connection with a hand-held hair dryer air outlet, said body portion having a forward end outlet opening for drying air, means for protecting a subject whose hair is being treated by directing drying air issuing from said outlet opening around the periphery of a cylindrical hair curling brush and away from the scalp of said subject including:

a forwardly extending arcuate drying air deflector integral at its rear end with the forward end of said body portion adjacent to one side of said outlet opening, said deflector extending forwardly of and curved transversely across said outlet opening in an arcuate path approximating a half circle permitting said cylindrical hair curling brush being placed above and across said deflector within the space encompassed by the arcuate deflector to curl hair while the deflector directs drying air issuing from the outlet opening away from the scalp of said subject.

2. A nozzle attachment for a hair dryer as defined in claim 1, and the outlet opening being in the form of a slit extending substantially across the width of said deflector, and said deflector comprising a substantially circularly curved plate-like deflector whose forward transverse edge terminates at an elevation substantially above said slit.

3. A nozzle attachment for a hand-holdable hair dryer comprising:

a body portion to be slipped over a hand-holdable hair dryer air outlet and having a forward end elongated slit-like drying air outlet opening, means for directing drying air issuing from said hand-holdable hair dryer slit-like outlet opening around the periphery of a cylindrical hair curling brush and away from the scalp of a subject whose hair is being treated including:

a forwardly extending elongated and arcuately curved deflector plate having its rear end fixedly secured to said body portion adjacent to one side of said slit-like air outlet opening, said deflector plate permitting a brush to be placed across the deflector plate for curling hair thus serving to deflect drying air away from the scalp in an arcuate path defined by the curvature of the deflector plate and curling of the hair.

* * * * *